US006722561B1

(12) United States Patent
Thomas et al.

(10) Patent No.: US 6,722,561 B1
(45) Date of Patent: Apr. 20, 2004

(54) FULL SERVICE LOCKED MAILBOX

(76) Inventors: Eva M. Thomas, 1521 SW. 13 Dr., Boca Raton, FL (US) 33486; William J. Thomas, 1521 SW. 13 Dr., Boca Raton, FL (US) 33486

( * ) Notice: Subject to any disclaimer, the term of this patent is extended or adjusted under 35 U.S.C. 154(b) by 0 days.

(21) Appl. No.: 09/904,137

(22) Filed: Jul. 12, 2001

(51) Int. Cl.[7] ..... B65D 91/00

(52) U.S. Cl. ..... 232/39; 232/45; 232/27; 232/33; 248/159

(58) Field of Search ..... 232/45, 17, 39, 232/43.1, 29, 33, 20, 21, 27; 248/159, 125.8, 407; 70/DIG. 63

(56) References Cited

U.S. PATENT DOCUMENTS

| | | | | | |
|---|---|---|---|---|---|
| 1,480,452 | A | * | 1/1924 | Kolstad | 232/17 |
| 1,592,405 | A | * | 7/1926 | Worley, Jr. et al. | 70/81 |
| 3,758,027 | A | * | 9/1973 | Morgan | 232/17 |
| 3,880,344 | A | * | 4/1975 | Earle | 232/17 |
| 4,413,770 | A | * | 11/1983 | Nye | 232/17 |
| 4,993,626 | A | * | 2/1991 | Berry | 232/17 |
| 5,096,115 | A | * | 3/1992 | Hassan | 232/17 |
| 5,207,377 | A | * | 5/1993 | Brecht | 232/17 |
| 5,267,688 | A | * | 12/1993 | Benefied | 232/17 |
| 5,351,883 | A | * | 10/1994 | Pachl | 232/17 |
| 5,526,979 | A | * | 6/1996 | Mann | 232/33 |
| 5,617,993 | A | * | 4/1997 | Morris | 232/27 |
| 6,244,505 | B1 | | 6/2001 | Grimes | 232/47 |

* cited by examiner

*Primary Examiner*—William L Miller
(74) *Attorney, Agent, or Firm*—Ronald V. Davidge

(57) ABSTRACT

A curbside mailbox wherein the outgoing mail compartment is located under the incoming mail compartment behind a single carrier service door. The incoming mail, when inserted, drops behind the outgoing mail compartment and falls into a deep mail storage area, to be retrieved by the owner through a locking rear access door. The rear access door retains a mechanical key lock and acts like a hasp fitting over a flange that is built into a upper rear wall. This feature allows the owner to double lock for added security or single lock placing a combination lock on the flange if the owner desires not to carry a key or give access to key for someone authorized to remove mail. The locking mailbox further includes a channel on top for a highly visible address display, a mounting channel on lower front to allow for quick and easy engagement, and a post cover assembly for safe and attractive installation.

16 Claims, 6 Drawing Sheets

FULL SERVICE LOCKED MAILBOX

FEDERALLY SPONSORED RESEARCH

Research and development of the present invention and application have not been Federally sponsored, and no rights are given under any Federal program.

SEQUENCE LISTING OR PROGRAM

Not Applicable

BACKGROUND

1. Field of Invention

The present invention pertains to mailboxes and their support post, and more particularly to full service, locking curbside mailboxes that comply with U.S. postal regulations and are theft and weather resistant, have a highly visible identification means, are attractive and safe, and are easy to install.

2. Description of Prior Art

Many people take mailboxes for granted. Mailboxes have become virtually invisible to most people. The reason being, the majority of curbside mailboxes are usually ugly bread-box shaped containers held up on a wooden post or metal stake. People have few alternatives to depend upon to hold the valuable information that mail often contains about their personal lives. This personal, and most times, confidential information is accessible to any unauthorized person who merely opens the mailbox door. Due to the increase of mail being stolen from mailboxes, identity theft has escalated to the extent that it is being called the crime of the 21st century. Resulting from the growing occurence of mail theft, the U.S. Postal Service has introduced a new locked mailbox classification that will provide customers with an option to purchase mailboxes that offer increased security for their mail. Many people are concerned with mail theft but may not be handy or just don't have the time to replace their mailbox. The U.S. Postal Service has standards for curbside mailboxes, but it does not regulate the design of mounting accessories for mailboxes. The Postal Operations Manual states that a mailbox shall be provided with a means for convenient and locked mounting that meets all applicable requirements set forth in the Postal Operations Manual. It also states that the installation and construction of curbside mailboxes shall conform to the rules and regulations of the U.S. Postal Service as well as standards established by the Highway Department's Task Force of Highway Safety.

Prior art locking type mailboxes are known in which the body of the mailbox has an elongated receiving neck leading to a lower storage chamber. The length or angle of the mailbox or a blocking element inside the body of the mailbox serve to prevent any unauthorized person from removing the mail by trying to reach into the lower storage chamber. Prior art locking type mailboxes are also known to have a lockable door on the lower storage chamber that is located on the front, back, or side of the body of the mailbox. Examples of such known prior art devices are set forth in U.S. Pat. No. Des. 354,610 to Hassan, U.S. Pat. No. 4,724,999 to Fitzgerald, U.S. Pat. No. 5,000,378 to Dorr, U.S. Pat. No. 5,148,974 to Clopper, U.S. Pat. No. 6,109,519 to McClure, U.S. Pat. No. 6,234,388 to Taylor, U.S. Pat. No. 6,244,505 to Grimes, U.S. Pat. No. 5,938,113 to Kim, U.S. Pat. No. 5,526,979 to Mann, U.S. Pat. No. 5,992,736 to Parker, U.S. Pat. No. 5,435,484 to Carlson, U.S. Pat. No. 5,400,960 to Jeffs, U.S. Pat. No. 5,096,115 to Hassan, U.S. Pat. No. 5,833,132 to Bachmeier, U.S. Pat. No. 5,617,993 to Morris, U.S. Pat. No. 5,351,883 to Pachl, U.S. Pat. No. 4,993,626 to Berry, U.S. Pat. No. 4,905,891 to Wildish, and U.S. Pat. No. 3,880,344 to Earle.

The general purpose of the present invention, which will be described subsequently in greater detail, is to provide a Postmaster General approved locking mailbox and means of installation which has many of the advantages of the prior art mentioned heretofore and many novel features that result in a new locking mailbox which is not anticipated, rendered obvious, suggested, or even implied by any of the known prior art mailboxes either alone or in any combination thereof. None of the known prior art provides a highly visible and uniform address channel; a unique rear access door that acts as a hasp, has a built in mechanical key lock and can accommodate an additional lock on a flange for added security or convenience; is provided with an attractive, convenient, safe, and easy means of installation; and is a theft and weather resistant locking mailbox that is safe to use while complying with U.S. postal regulations and the Highway Department's Task Force for Highway Safety. Thus, the need exists for an improved, aesthetically pleasing, safe and simple to install and use, locked, weather and theft resistant mailbox, that allows for highly visible identification and mail storage, and is approved by the Postmaster General.

OBJECTS AND ADVANTAGES

Accordingly, besides the objects and advantages of the locking mailbox described in our above patent, several objects and advantages of the present invention are:

(a) to provide an improved full service locking mailbox that has incoming and outgoing mail compartments that are weather and theft resistant located behind a single carrier access door;

(b) to provide an attractive, uniform, and highly visible means of displaying an address not only for delivery personal but also for Emergency Services;

(c) to provide a lockable mail access door on the back side of the mailbox so a person authorized to retrieve mail does not have to enter a street or roadway in front of the mailbox and expose themselves to danger or create a safety hazard;

(d) to provide a mailbox that is deep enough so an unauthorized person cannot reach down to remove mail, and has a large enough storage area that can hold mail for a period of time while the owner is away;

(e) to provide a full service locking mailbox that has all the standards required by the U.S. Postal Service and thus can be approved by the Postmaster General;

(f) to provide a safe, attractive, simple in design and operation, inexpensive to manufacture, and structurally stable locking mailbox;

(g) to provide an optional means of locking the rear mail access door; and (h) to provide an easy, safe, and attractive means of installation that is approved and recommended by the Highway's Task Force for Highway Safety.

Additional objects and advantages of the invention will become apparent from a consideration of the ensuing description and drawings.

SUMMARY OF INVENTION

The present invention provides a full service locking mailbox that is safe, weather and theft resistant, has a highly visible address display channel, a unique rear access door, and a post cover assembly for attractive, quick, safe, and easy installation. The locking mailbox and post cover assembly are preferably constructed of a type of plastic material. The material's thickness, form, and mechanical properties will more than adequately meet the operational, structural, and performance requirements set forth by postal regulations. The material the locking mailbox is constructed of will not be toxic, flammable, transparent, or hazardous in any way. The body of the full service locking mailbox is a vertically extended rectangular housing leading to a lower mail storage area. The shape of the body of the locking mailbox is deep enough for mail to drop to the bottom so that an unauthorized person cannot remove it. The top of the locking mailbox extends slightly beyond the carrier service door in the front. In the back the top slopes and extends slightly beyond the rear access door creating overhangs that act as barriers for moisture from entering the locking mailbox.

Mailboxes are not only used for incoming mail delivery and outgoing mail pickup, but also as a means for identification. Should street names and numbers be assigned by local authorities, a postmaster authorizes their use as a postal address. The number is then used as a means of identifying a location, usually a residence or business. This number according to postal regulations must be inscribed in a contrasting color and in legible numerals at least one inch high on the side of the mailbox that is visible to the carriers approach. Emergency Services require three inch numbers to allow for easy identification of a location. The top of the body of the locking mailbox includes a dovetail channel that is designed to hold highly visible address numbers that are affixed to plates that slide into the channel so that delivery and especially emergency personnel may quickly and easily locate a residence. The address plates with numbers affixed to both sides are highly visible by all approaches. A carrier signal flag, used to indicate to the carrier that outgoing mail is present, is made of a plastic material having no sharp edges and having a minimum visible area of 4 square inches when engaged. It is mounted on the right side of the mailbox when facing it from the front, as required by postal regulations.

Both the incoming and outgoing mail compartments are located behind a single carrier service door in the forwardly extended top part of the body of the locking mailbox. The single carrier service door provides access for incoming mail delivery and outgoing mail collection. The carrier service door has an easy-to-grip handle located within the top third of the door and operates freely and solely by pulling outward and downward. The door and the opening for the door have a built-in seal that provides protection against wind, rain, sleet, and snow. The carrier service door is held closed by a means such as a magnet. The carrier service door, when open, swings further than 180 degrees but will come to rest no further than 180 degrees, as required by postal regulations. The carrier service door has no protrusions other than a handle and magnet. Neither of these will interfere with delivery nor present a safety hazard. On its exterior, the carrier service door will have permanent markings that read US MAIL and APPROVED BY THE POSTMASTER GENERAL as required by postal regulations.

The outgoing mail compartment is located under the incoming mail compartment. The incoming mail, when inserted, drops behind the outgoing mail compartment and falls to the bottom of the vertically extended rectangular body into the storage area. The incoming mail can be retrieved by an authorized person through a lower lockable rear access door. The locking rear access door is located in back of the mailbox in order for an authorized person to remove mail away from any passing traffic so as not to expose themselves to danger or create a safety hazard. The entire bottom area of both the incoming and outgoing mail compartments where the mail rests is fabricated to prevent mail from being damaged due to compensation or moisture. The resulting surface area that touches the mail does not exceed 0.25 square inch per dimple or impression and is a minimum of 0.12 inches high on centers not exceeding one inch, as required by postal regulations. The upper back wall terminates a short distance below the slanted top of the locking mailbox body to allow for an opening to access mail. The upper back wall performs the function of stopping the rear access door and retaining a flange for the rear access door to fit over. The locking rear access door of the locking mailbox is designed for an authorized person, not the mail carrier, to access delivered mail. The rear access door does not interfere with the normal delivery and collection of mail by the carrier, and is not susceptible to being forced open by large items inserted through the carrier service door. The locking rear access door has the same type of built-in seal as the carrier service door has to provide protection against harsh weather. The rear access door is held closed by a built-in mechanical key lock. An easy-to-grip handle is located on the rear access door so that it may be pulled open with little force. A small opening near the mid top of the rear access door fits over a flange that is part of the upper back wall of the locking mailbox. The opening fits over the flange and allows the rear access door to act as a hasp that can hold an optional padlock or combination lock. This construction allows for added security or convenience. The rear access door can be double locked for added protection of mail, or single locked using a combination lock on the flange if the owner desires not to carry a key or give access to key for someone authorized to remove mail.

A post cover assembly in accordance with the present invention includes a telescoping post cover preferably made of the same material as the locking mailbox. The Highway Department's Task Force for Highway Safety states that the ideal support is an assembly which, when struck, will bend or fall away from the striking vehicle instead of severely damaging the vehicle and injuring its occupants. Supports that bend are most desirable although 100 mm×100 mm wood post may be used. Mailboxes should be properly attached so as not to become missiles if impacted. The design of mailboxes and their support have a direct correlation to the damage and injury caused by a vehicle's impact. The telescoping post cover assembly is made to slide over a wooden post and/or a metal ground engaging stake and adjusts to the height needed for proper installation as set forth by postal regulations and the Highway Departments Task Force for Highway Safety. The post cover assembly has a raised ridge running longitudinally along opposite sides of the telescoping body. This raised ridge allows the telescoping post cover to slide into or out of itself and contributes to the initial positioning of the mailbox. The locking mailbox has a mounting channel located under the carrier service door that extends vertically to the bottom of its body. A recessed groove runs vertically along opposite sides of the mounting channel. The locking mailbox is engaged to the post cover assembly by the raised ridge in the post cover sliding into the recessed grove in the mounting channel. Fastening means such as screws can be inserted to penetrate the post cover, the wooden post and/or the ground engaging stake through an open rear access door allowing for easy, inconspicuous and secure mounting. An alternate method of installation provides a means of attaching the locking mailbox to a multiple mailbox support by means of inserting a fastening means such as screws to penetrate through the multiple support and into the bottom of the outgoing mail compartment.

These and other objects, features, and advantages of the present invention will become apparent upon review of the detailed description set forth below and taken in conjunction with the accompanying drawings, which are briefly described as follows.

REFERENCE NUMERALS IN DRAWINGS

Figure 1:
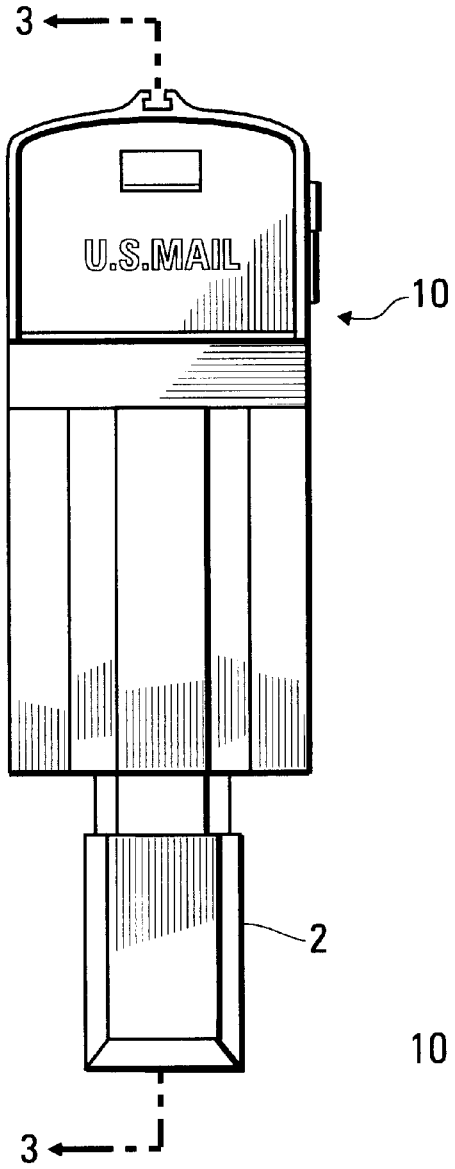
FIG. 1 is a perspective view of the locking mailbox according to the present invention and mounted upon the post cover assembly.

| | | | |
|---|---|---|---|
| 2 | post cover assembly | 24 | carrier service door |
| 4 | outgoing mail compartment | 26 | easy grip handle |
| 6 | incoming mail compartment | 28 | magnet |
| 8 | top | 30a | weather resistant seal on carrier service door |
| 8a | front top overhang | 30b | weather resistant seal on rear access door |
| 8b | rear top overhang | 32 | mounting channel |
| 10 | LOCKING MAILBOX | 34 | recessed groove |
| 12 | dovetail address channel | 36 | carrier signal flag |
| 14 | fabricated base | 38 | opening |
| 16 | mail storage area | 40 | rear access door |
| 18a | right upstanding side wall | 42 | flange |
| 18b | left upstanding side wall | 44 | rear door easy grip handle |
| 20 | back wall | 46 | mechanical key lock |
| 20a | upper back wall | 48 | opening for flange |
| 20b | lower back wall | 56 | raised ridge |
| 22 | front wall | | |
| 22a | upper front wall | | |
| 22b | lower front wall | | |

DETAILED DESCRIPTION OF THE DRAWINGS

FIGS. 1–9 show a preferred embodiment of the present invention where the preferred embodiment is identified in its entirety by the reference numeral 10 and where like numerals refer to like parts throughout the drawings. While the configuration according to the illustrated embodiment is preferred, it is envisioned that alternate configurations of the present invention may be adopted without deviating from the invention as portrayed. The preferred embodiment is discussed hereafter.

Figure 2:
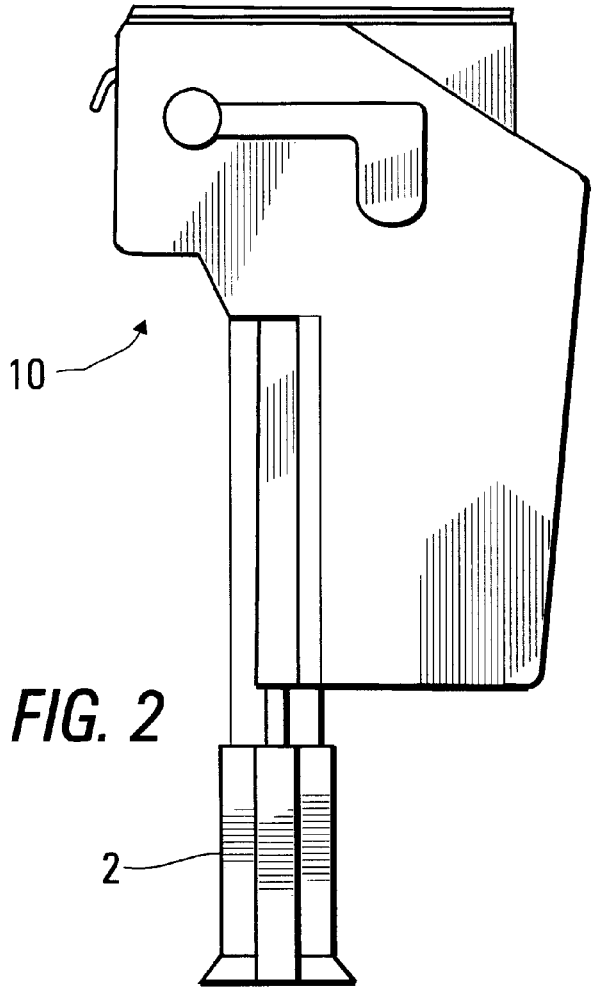
FIG. 2 is a side elevational view of the present invention and mounted upon a post cover assembly.
Figure 3:
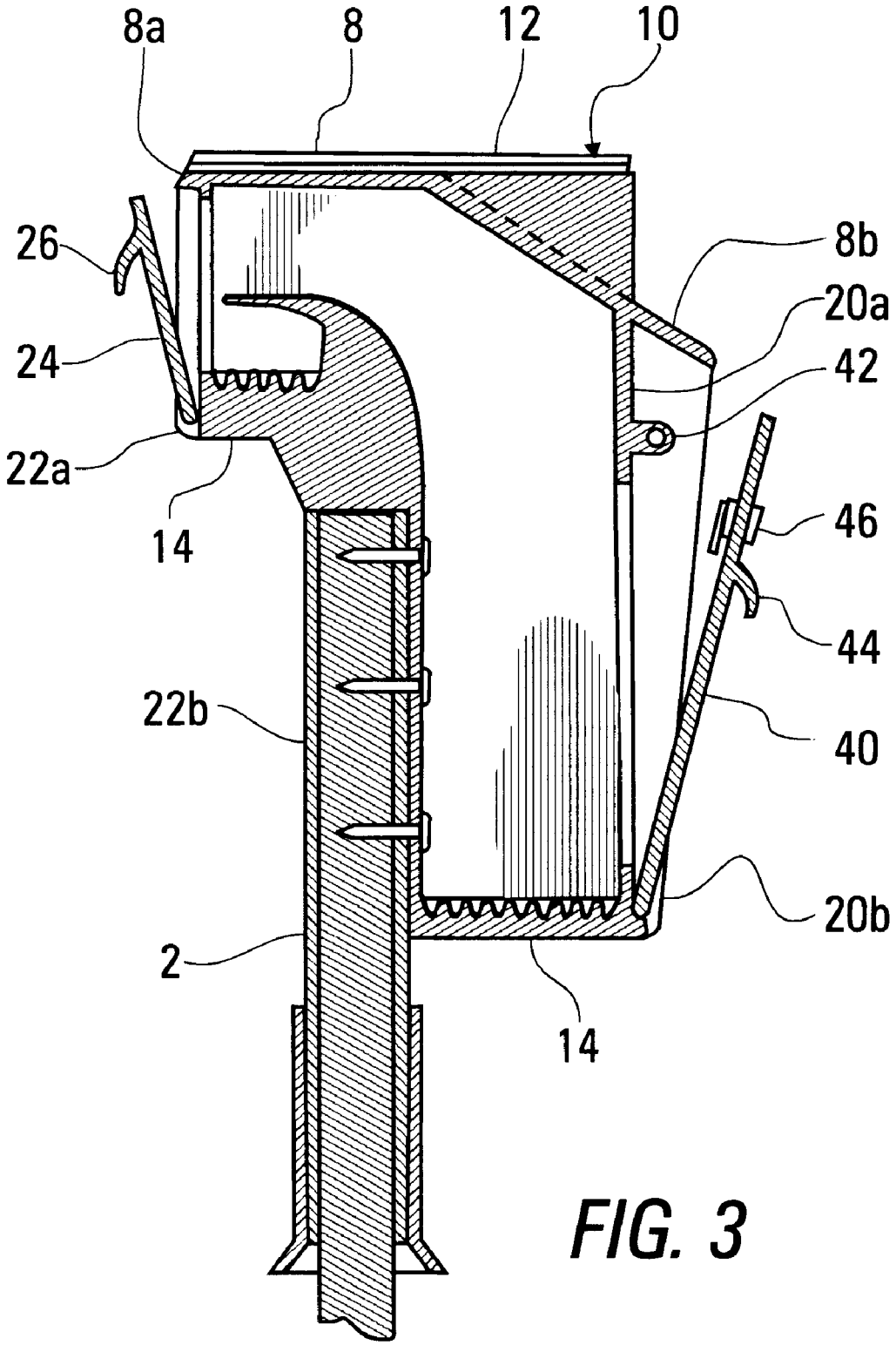
FIG. 3 is a vertical cross sectional view taken substantially along the line 3—3 of FIG. 1 illustrating the internal construction of the present invention.
Figure 4:
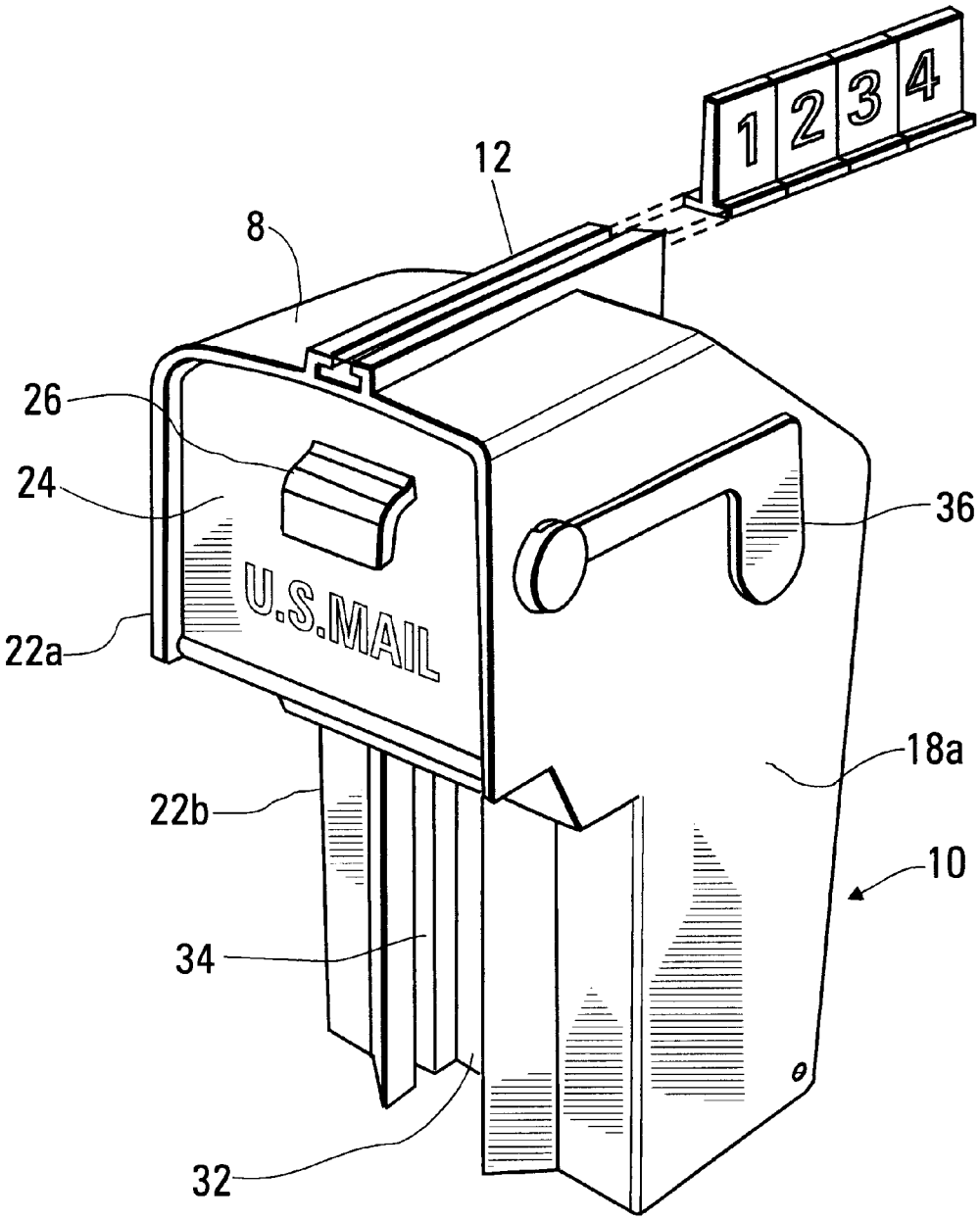
FIG. 4 is a front view of the present invention to more fully illustrate its external construction not mounted upon the post cover assembly.
Figure 5:
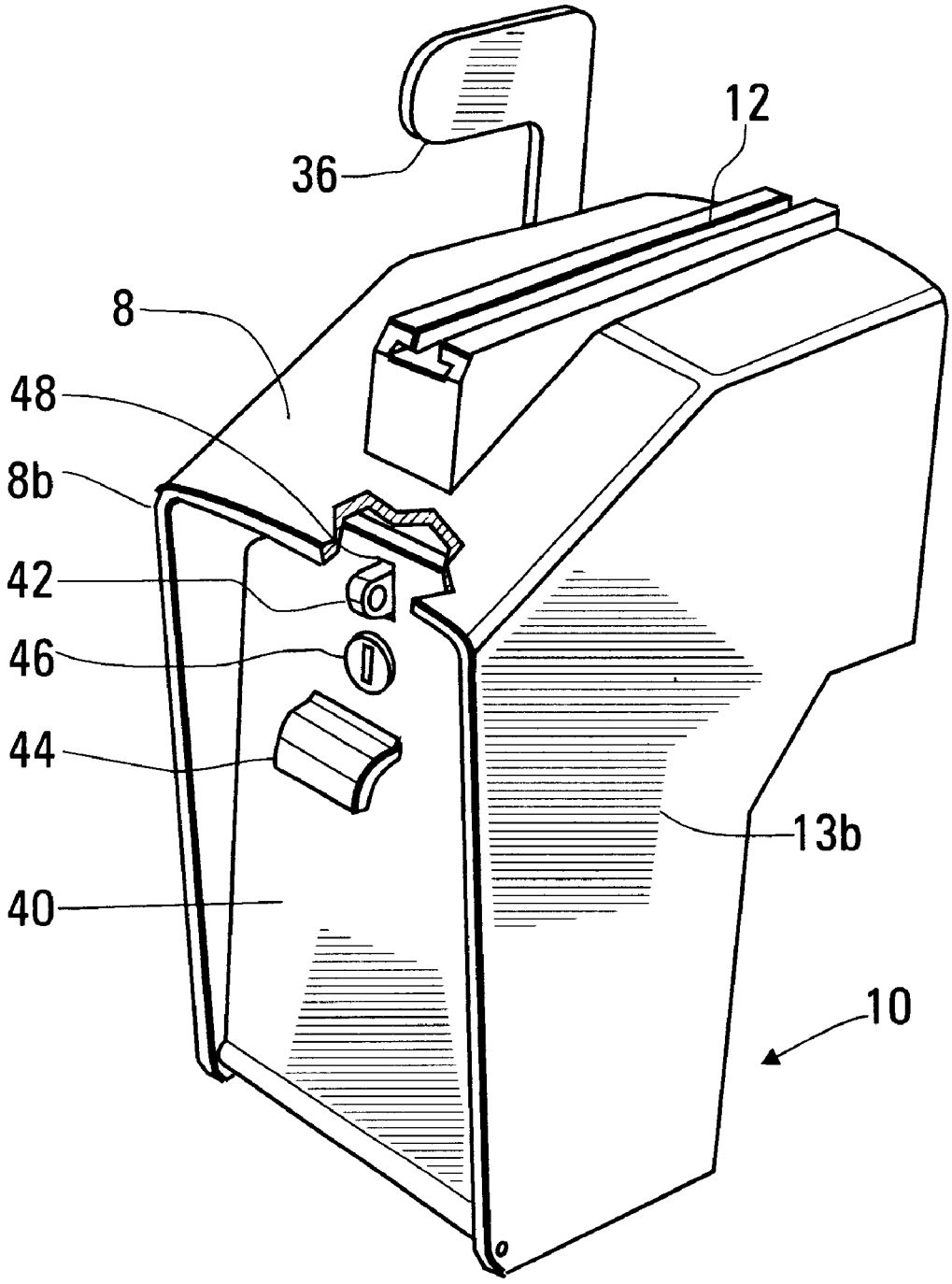
FIG. 5 is a rear view of the present invention to more fully illustrate its external construction not mounted upon the post cover assembly.
Figure 6:
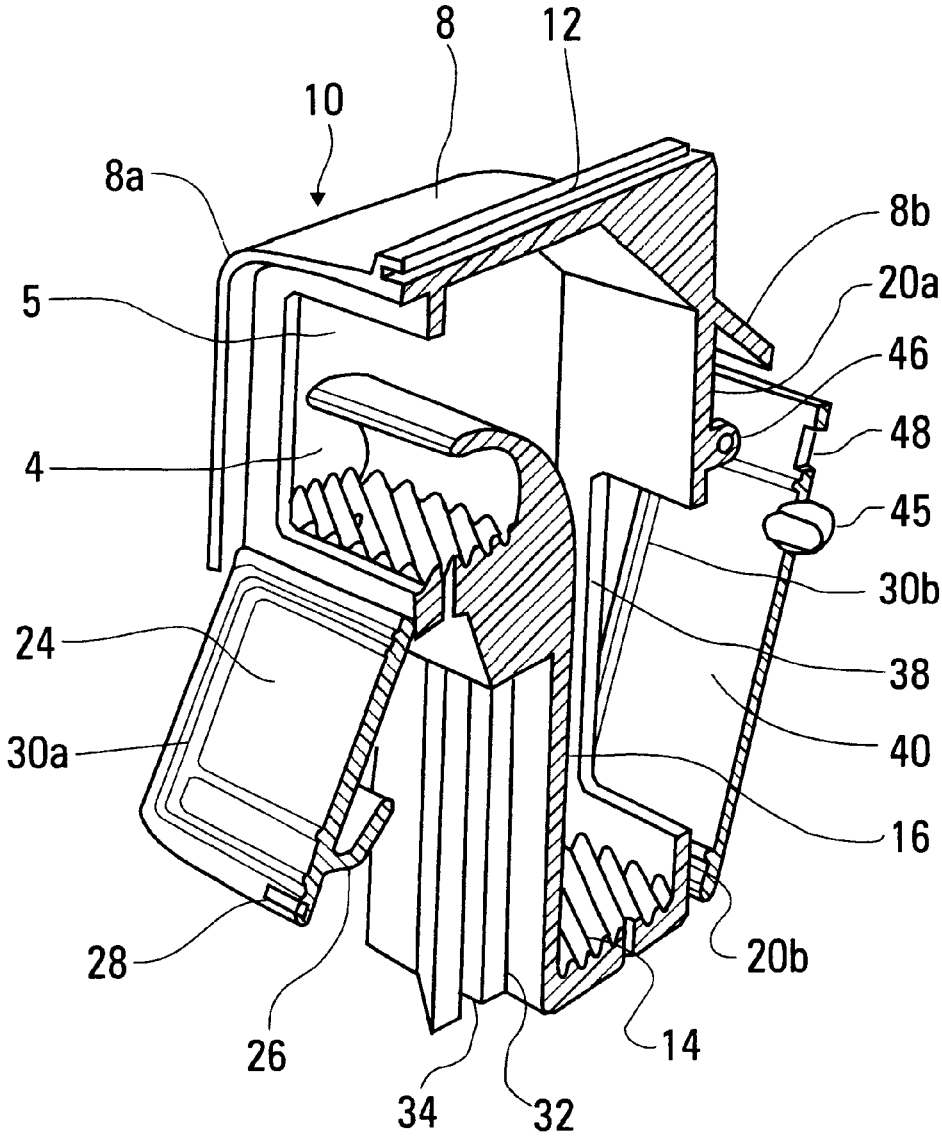
FIG. 6 is a vertical cross sectional view taken substantially along line 4—4 of FIG. 4 showing the carrier service door open and the rear access door open and illustrating the internal construction of the present invention.

Referring first to FIGS. 1–2, a perspective view of a locking mailbox 10 according to the present invention is illustrated in place upon a post cover assembly 2. Referring to FIGS. 3–5, the locking mailbox 10, defining an enclosed area to contain an outgoing mail compartment 4, and an incoming mail compartment 6, includes a top 8 that is slanted towards the back and overhangs the front 8*a* and back 8*b*, a longitudinal dovetail address channel 12 on the top mid-section to hold plates that have affixed address numbers, a horizontal base 14 fabricated to prevent mail from being damaged due to condensation or moisture that extends below a storage area 18, upstanding side walls 18*a* and 18*b*, back upper wall 20*a*, back lower wall 20*b*, and front wall 22. The front wall 22 is further provided with an upper front wall 22*a* and a lower front wall 22*b*. The upper front wall 22*a* is extended forwardly and is provided with a pivotally hinged carrier service door 24 having an easy grip handle 26 located within the top third of the door, a magnet 28 for closure, and a weather resistant seat 30*a*. The lower front wall 22*b* is provided with a mounting channel 32 that has a recessed groove 34 running vertically along opposite sides of the channel. A carrier signal flag 36 is pivotally attached to the upper right side wall 18*a*. When the flag 36 is raised to indicate the presence of outgoing mail, it remains in that position until retracted by the mail carrier. Flag 38 has a minimum visible area of 4 square inches when engaged and has no sharp edges.

The back wall 20 is further provided with the upper back wall 20*a* and the lower back wall 20*b*. The upper back wall 20*a* terminates a short distance below the back overhang 8*b* to allow for an opening 38 to access mail. The upper back wall 20*a* performs the function of stopping the rear access door 40 and retaining a flange 42 for the rear access door to fit over. The rear access door 40 is pivotally hinged to the lower back wall 20*b*. The rear access door 40 has an easy to grip handle 44 on the exterior that operates freely and solely by pulling outward and downward, and has a weather resistant seal 30*b* that provides protection against harsh weather. The rear access door 40 is provided with a mechanical key lock 46. A small opening 48 is provided near the top mid section of the rear access door 40 allowing the flange 42 to fit through the opening 48 allowing the rear access door 40 to act like a hasp that can accommodate a combination or padlock.

Figure 7:
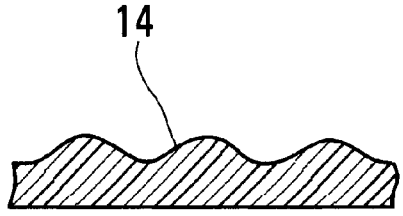
FIG. 7 is a fragmented cross sectional view of the fabricated base in the outgoing mail compartment and the incoming mail storage area.

The carrier service door 24, when open exposes the outgoing mail compartment 4 below the incoming mail compartment 6. The incoming mail, when inserted drops behind the outgoing mail compartment 6 and falls into the storage area 16, and comes to rest on the fabricated horizontal base 14. The entire bottom area of the outgoing mail compartment 4 and the incoming mail storage area 16 where the mail rests is fabricated 14 to prevent mail from being damaged due to condensation or moisture. FIG. 7 shows the resulting fabricated surface 14 that touches the mail does not exceed 0.25 square inch per dimple or impression and is a minimum of 0.12 inches high on centers not exceeding one inch.

Figure 8:
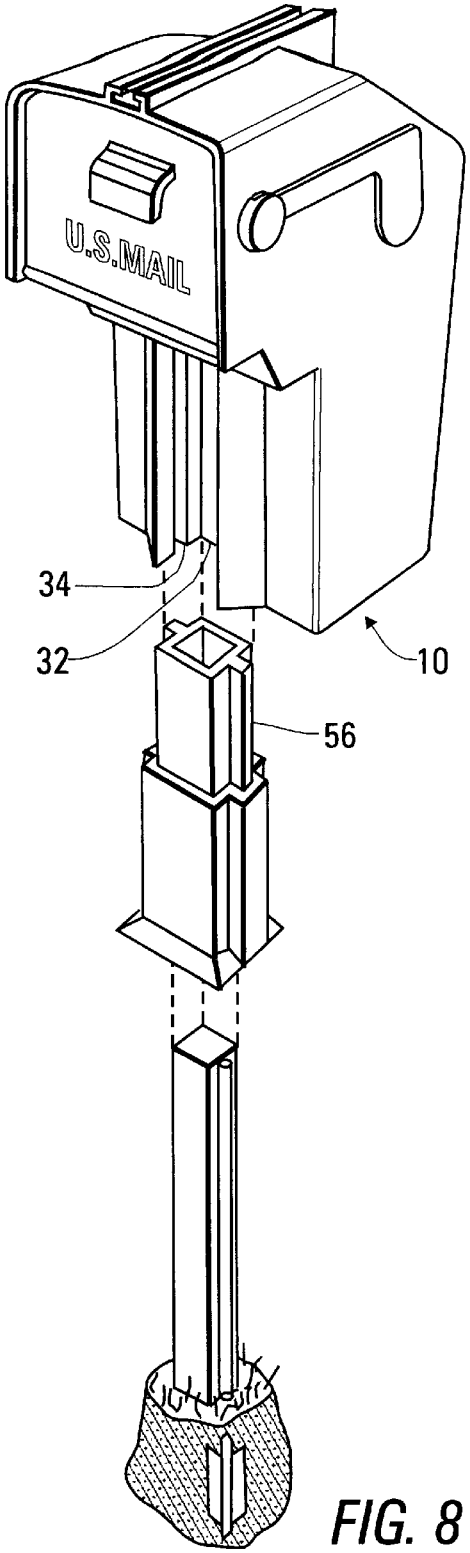
FIG. 8 is an exploded view of the present invention mounted upon the post cover assembly illustrating mounting technique.
Figure 9:
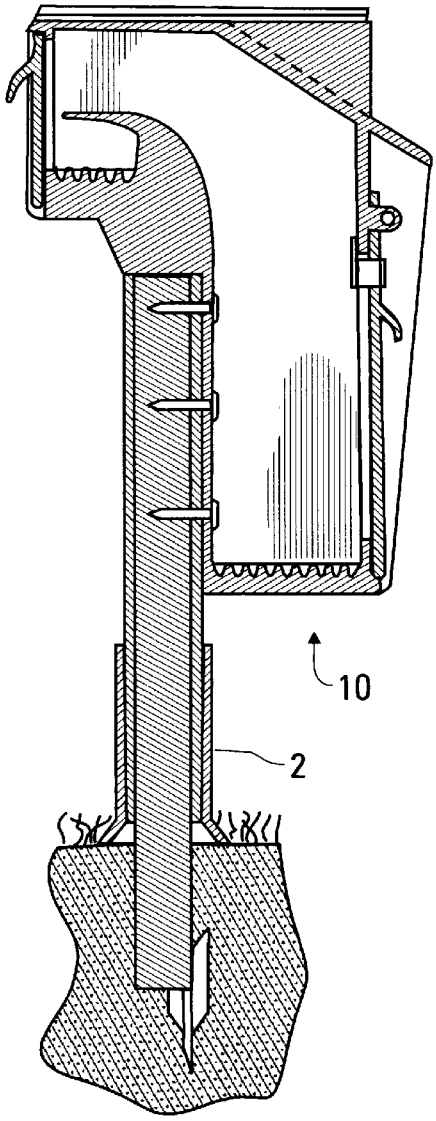
FIG. 9 is a vertical cross sectional view of the present invention illustrating fastening method to post cover assembly and wooden post and/or metal stake.

Referring to FIGS. 8–9, the preferred embodiment of the locking mailbox includes a post cover assembly 2, that is made to engage into position the locking mailbox 10. The post cover assembly 2, is provided to fit over a wooden post and/or a metal ground engaging stake for safe and easy installation. The post cover assembly 2 is telescoping so that it slides into or out of itself providing height adjustment for proper installation. The post cover assembly 2 has a raised ridge 56 running along opposite sides that fit into the mounting channels 32 recessed groove 34 engaging into proper position the locking mailbox 10. When the rear access door is in an open position, fastening means such as screws are inserted through the rear opening and penetrate the lower body of the locking mailbox 10, the post cover assembly 2, and the wooden post and/or the ground engaging stake.

While a preferred embodiment of the present invention has been disclosed in the foregoing specification, it is understood by those skilled in the art that variations and modifications thereof can be made without departing from the spirit and scope of the invention as set forth in the following claims.

OPERATION OF PREFERRED EMBODIMENT

The locking mailbox 10 will be properly located and mounted using guidelines set forth in the Postal Operations Manual and the Highway's Task Force for Highway Safety. The locking mailbox 10 will be classified as full service because both the outgoing mail compartment 4, and the incoming mail compartment 6, are located within the body of the mailbox, and a carrier signal flag 36, to alert the carrier that outgoing mail is located within the interior, is mounted on the outside of the body of the mailbox.

A longitudinal dovetail channel 12 is provided on the mid top of the locking mailbox 10. The postal service requires that every curbside mailbox must bear numerals at least one inch high on the side of the mailbox that is visible to the carrier's approach. Emergency Services require three inch numbers to help identify a residence. The dovetail channel 12 allows plates that have numbers affixed on them to easily slide into the channel and lock into place (see FIG. 4). The plates can accommodate numbers up to three inches high. The numbers are affixed to both sides of the plates allowing highly visible identification by all approaches.

Both the outgoing mail compartment 4 and the incoming mail compartment 6 are located behind a single carrier service door 24 in the forwardly extended upper front wall 22*a* of the body of the locking mailbox 10. The outgoing mail compartment 4 is located under the incoming mail compartment 6. The incoming mail, when inserted, drops behind the outgoing mail compartment 4 and falls to the bottom of the vertically extended rectangular body into the storage area 16 to be retrieved by an authorized person through a lower lockable rear access door 40. The shape of the body of the locking mailbox 10 is deep enough for mail to drop to the bottom so that an unauthorized person cannot remove it.

The single carrier service door 24, operates freely and solely by pulling outward and downward on an easy grip handle 26. The carrier is able to deposit a customer's mail by a single motion of the carriers arm and is able to access outgoing mail by pulling it straight out of the locking mailbox without any interference. The carrier service door is held closed with a means such as a magnet 28, that allows for easy opening and closing and requires no more than 5 pounds of force. The carrier is alerted that the carrier service door 24 is properly shut by either a tactile or sound such as a snap or click. When the carrier service door 24 is open, it swings further than 180 degrees but comes to rest no further than 180 degrees, so as not to require the carrier to reach beyond what is necessary. When the door is open, it remains in that position until the carrier closes it. No protrusions other than the magnet 28, and the easy grip handle 26, are on the door, so that there is no interference with delivery or safety hazard created when the carrier service door 24 is in the open position. The locking mailbox 10 has two inscriptions on the exterior of the carrier service door 24, U.S. MAIL in a minimum of 0.50 inch high letters, and APPROVED BY THE POSTMASTER GENERAL in a minimum of 0.18 inch high letters. A decal with the manufacturers name, address, date of manufacture, and model number is affixed to the backside of he carrier service door 24.

The overhangs 8*a* and 8*b* above the carrier service door 24 and the rear access door 40, and the weather resistant seals 30*a* and 30*b* on both doors allow the locking mailbox 10 to protect mail from water damage which may result from wet weather conditions. In addition, the entire bottom area of both the outgoing mail compartment 4, and incoming mail storage area 16, where the mail rests, is fabricated 14 to prevent mail from damage due to moisture or condensation. The resulting surface area that touches the mail does not exceed 0.25 square inch per dimple or impression and is a minimum of 0.12 inches high on centers not exceeding one inch, see FIG. 7.

A carrier signal flag 36 is mounted on the right side wall 18*a* when facing the locking mailbox 10 from the front. The flag 36 has a minimum visible area of 4 square inches when engaged and has no sharp edges. The flag 36 does not require a lift of more than 2 pounds of force to retract. When the flag 36 is in an upright position indicating that outgoing mail is to be picked up, it remains in that position until it is retracted by the carrier.

The locking rear access door 40 is located in back of the locking mailbox 10 so an authorized person removing mail is away from any passing traffic so there is no danger of being hit by a vehicle, nor creating a safety hazard. The locking mailbox 10 has a rear access door 40 that does not interfere with the normal delivery and collection operation provided by the carrier, nor does it require the carrier to perform any unusual operation. The rear access door 40 is not susceptible to being forced open when articles fall into the storage area 16. The rear access door 40 is designed for an authorized person, not the carrier to access the mail storage area 16. When the rear access door 40 is open, it rotates a maximum of 90 degrees allowing the door to act as a holding area while accessing additional mail. A key locking mechanism 46 is built into the rear access door 40. An opening 48 in the upper mid section of the rear access door 40 is designed to fit over a flange 42 on the upper back wall 20*a*. This feature allows the rear access door 40 to act as a hasp fitting over the flange which can hold an optional combination or padlock allowing for added security or convenience. The rear access door 40 can be double locked for added protection of mail in the storage area 16, or single locked using a combination lock on the flange 42 if the owner does not desire to carry a key or give access to key to someone authorized to remove the mail.

The locking mailbox 10 is designed to be mounted on a post cover assembly 2. Although the U.S. Postal Service does not regulate the design of mounting accessories for mailboxes, it states that a mailbox shall be provided with a means for convenient and locked mounting that meets all applicable requirements set forth in the Postal Operations Manual. It is also stated that the installation and construction of curbside mailboxes shall conform to the rules and regulations of the U.S. Postal Service as well as standards established by the Highway Department's Task Force of Highway Safety. The Highway Department's Task Force for Highway Safety states that the ideal support is an assembly which, when struck, will bend or fall away from the striking vehicle instead of severely damaging the vehicle and injuring its occupants. Supports that bend are most desirable although 100 mm×100 mm wood post may be used. Mailboxes should be properly attached so as not to become missiles if impacted. The telescoping post cover assembly 2 is made to slide over a wooden post and/or a metal ground engaging stake and adjusts to the height needed for proper installation as set forth by postal regulations and the Highway's Task Force for Highway Safety. The post cover assembly 2 is made of a plastic material that, when struck, should break apart and not cause any damage to the striking vehicle or its occupants. The wooden post and/or metal stake that the post cover assembly conceals and fits over will bend or fall away from the striking vehicle. The post cover assembly 2 has a raised ridge 56 running vertically along opposite sides of the telescoping body. The raised ridge 56 allows the telescoping post cover assembly 2 to slide into or out of itself and contributes to the initial positioning of the locking mailbox 10. The locking mailbox 10 has a mounting channel 32 located in the lower front wall 22*a* underneath the carrier service door 24. The mounting channel 32 extends vertically to the bottom of the body of the locking mailbox 10. A recessed groove 34 runs vertically along opposite sides of the mounting channel 32. The locking mailbox 10 is engaged to the post cover assembly 2 by the raised ridge 56 in the post cover sliding into the recessed grove 34 in the mounting channel (FIG. 8). Fastening means such as screws can be inserted to penetrate the post cover assembly 2, and the wooden post and/or the ground engaging stake through an open rear access door 40 allowing for quick, easy, inconspicuous and secure mounting (FIG. 9).

While the preferred specific embodiment is herein disclosed, it is to be clearly understood that the invention is not to be limited to the exact constructions, mechanisms and devices illustrated and described because various modifications of these details may be provided in putting the invention into practice.

We claim all modifications and variation coming within the spirit and scope of the following claims:

1. Locking mailbox apparatus comprising:

a housing including:

a cavity for holding incoming mail;

a cavity for holding outgoing mail;

a front upper wall including a front aperture disposed outwardly adjacent an upper opening to said cavity for holding incoming mail and a lower opening to said cavity for holding outgoing mail;

a front lower wall disposed below and rearward from said front upper wall, wherein said front lower wall includes a mounting channel extending vertically to a lower end of said front lower wall;

a back wall including a back aperture providing access to said cavity for holding incoming mail and an outward extending flange, wherein said cavity for holding incoming mail extends within said housing rearward between said front upper wall and downward between said front lower wall and said back wall, and wherein said cavity for holding outgoing mail extends within said housing rearward from said front upper wall;

a top having a front portion extending forward beyond said front upper wall and a rear edge extending rearward beyond said back wall, wherein a rear portion of said top slants downward between said front portion of said top and said rear edge, and plate receiving means for receiving plates with affixed identification numbers;

a carrier service door pivotally attached to said front upper wall covering said front aperture in a closed position, wherein said carrier service door includes a handle, a weather-resistant seal, and holding means for holding said carrier service door in said closed position, wherein said carrier service door is pivoted downward through an angle not exceeding 180 degrees between said closed position and an open position, and where said carrier service door in said closed position is disposed under said front portion of said top; and a rear access door attached by a hinge to said back wall to cover said back aperture in a closed position, including a handle, a weather resistant seal, a mechanical key lock, and a small opening, wherein said outward extending flange of said back wall extends through said small opening with said rear access door in said closed position to provide for locking said rear access door in said closed position with an additional lock.

2. The locking mailbox of claim 1, wherein said holding means comprises a magnetic latch.

3. The locking mailbox of claim 1, wherein said mounting channel includes a recessed mounting groove.

4. A locking mailbox comprising:

a housing including:

a cavity for holding incoming mail;

a cavity for holding outgoing mail;

a front upper wall including a front aperture disposed outwardly adjacent an upper opening to said cavity for holding incoming mail and a lower opening to said cavity for holding outgoing mail;

a front lower wall disposed below and rearward from said front upper wall, wherein said front lower wall includes a mounting channel extending vertically to a lower end of said front lower wall;

a back wall including a back aperture providing access to said cavity for holding incoming mail and an outward extending flange;

a top having a front portion extending forward beyond said front upper wall and a rear edge extending rearward beyond said back wall, wherein a rear portion of said top slants downward between said front portion of said top and said rear edge, and plate receiving means for receiving plates with affixed identification numbers;

a carrier service door pivotally attached to said front upper wall covering said front aperture in a closed position, wherein said carrier service door includes a handle, a weather-resistant seal, and holding means for holding said carrier service door in said closed position, wherein said carrier service door is pivoted downward through an angle not exceeding 180 degrees between said closed position and an open position, and where said carrier service door in said closed position is disposed under said front portion of said top;

a rear access door attached by a hinge to said back wall to cover said back aperture in a closed position, including a handle, a weather resistant seal, a mechanical key lock, and a small opening, wherein said outward extending flange of said back wall extends through said small opening with said rear access door in said closed position to provide for locking said rear access door in said closed position with an additional lock, and a post cover assembly for extending around a post, including a first portion and a second portion sliding within said first portion for height adjustment, wherein said post cover assembly is attached to said housing within said mounting channel in said front lower wall.

5. The locking mailbox of claim 4, wherein said holding means comprises a magnetic latch.

6. The locking mailbox of claim 4, wherein said mounting channel includes a recessed mounting groove, and said post cover assembly includes a ridge extending within said recessed mounting groove.

7. Locking mailbox apparatus comprising:

a housing including:

an upper front wall;

a lower front wall disposed below and rearward from said upper front wall, including a vertical mounting channel extending within said lower front wall for mounting said housing on a post;

a back wall disposed rearward from said upper front wall and said lower front wall;

a cavity for holding incoming mail extending rearward within said housing from an upper opening in said upper front wall, downward between said lower front wall and said back wall, and into a rear opening in said back wall; and a cavity for holding outgoing mail extending, within said housing below said cavity for holding incoming mail, rearward from a lower opening in said upper front wall;

a carrier service door pivotally attached to said upper front wall to cover said upper and lower openings in a closed position; and a lockable rear access door pivotally attached to said back wall to cover said rear opening in said back wall.

8. The locking mailbox apparatus of claim 7, wherein said housing additionally comprises a top having a front portion extending forward beyond said front upper wall and a rear edge extending rearward beyond said back wall, wherein a rear portion of said top slants downward between said front portion of said top and said rear edge, and plate receiving means for receiving plates with affixed identification numbers.

9. The locking mailbox apparatus of claim 7, wherein said lockable rear access door is held in a closed position by two separate locking mechanisms.

10. The locking mailbox apparatus of claim 7, wherein said vertical mounting channel includes a recessed mounting groove.

11. The locking mailbox apparatus of claim 7, additionally comprising a post cover assembly, fitting within said vertical mounting channel and extending downward from said housing, for extending around a post within said vertical mounting channel.

12. The locking mailbox apparatus of claim 11, wherein said mounting channel includes a recessed mounting groove, and said post cover assembly includes a ridge extending within said recessed mounting groove.

13. The locking mailbox apparatus of claim 11, wherein said post cover assembly includes:

a first portion, and a second portion sliding within said first portion for height adjustment.

14. The locking mailbox apparatus of claim 11, wherein said housing additionally comprises a top having a front portion extending forward beyond said front upper wall and a rear edge extending rearward beyond said back wall, wherein a rear portion of said top slants downward between said front portion of said top and said rear edge, and plate receiving means for receiving plates with affixed identification numbers.

15. The locking mailbox apparatus of claim 11, wherein said lockable rear access door is held in a closed position by two separate locking mechanisms.

16. The locking mailbox apparatus of claim 7, wherein said lockable rear access door is held in a closed position by two locking mechanisms.

* * * * *